US008753163B2

(12) United States Patent
Gaute

(10) Patent No.: US 8,753,163 B2
(45) Date of Patent: Jun. 17, 2014

(54) TOY BUILDING SYSTEM

(75) Inventor: Munch Gaute, Langa (DK)

(73) Assignee: Lego A/S, Billund (DK)

( * ) Notice: Subject to any disclaimer, the term of this patent is extended or adjusted under 35 U.S.C. 154(b) by 1219 days.

(21) Appl. No.: 12/227,723

(22) PCT Filed: May 23, 2007

(86) PCT No.: PCT/DK2007/000244

§ 371 (c)(1),
(2), (4) Date: Mar. 13, 2009

(87) PCT Pub. No.: WO2007/137577

PCT Pub. Date: Dec. 6, 2007

(65) Prior Publication Data

US 2009/0305602 A1 Dec. 10, 2009

(30) Foreign Application Priority Data

May 29, 2006 (DK) ..... 2006 00726

(51) Int. Cl.
*A63H 33/04* (2006.01)

(52) U.S. Cl.
USPC ..... 446/91; 446/85

(58) Field of Classification Search
USPC ..... 446/91
See application file for complete search history.

(56) References Cited

U.S. PATENT DOCUMENTS

| | | | | |
|---|---|---|---|---|
| 3,696,548 | A * | 10/1972 | Teller | 446/91 |
| 4,936,185 | A * | 6/1990 | Yamaguchi et al. | 84/670 |
| 5,697,829 | A | 12/1997 | Chainani et al. | |
| 6,227,931 | B1 | 5/2001 | Shackelford | |
| 6,290,565 | B1 | 9/2001 | Galyean, III et al. | |
| 6,443,796 | B1 * | 9/2002 | Shackelford | 446/91 |
| 6,585,553 | B1 * | 7/2003 | Fetridge et al. | 446/91 |
| 6,773,322 | B2 | 8/2004 | Gabai et al. | |
| 6,939,195 | B1 | 9/2005 | Hunt et al. | |
| 7,846,002 | B1 * | 12/2010 | Mikesell et al. | 446/91 |
| 2003/0175669 | A1 | 9/2003 | Mimlitch et al. | |
| 2004/0185745 | A1 * | 9/2004 | Reining et al. | 446/91 |

FOREIGN PATENT DOCUMENTS

| | | | |
|---|---|---|---|
| EP | 0590432 | A2 | 4/1994 |
| EP | 1616607 | A1 | 1/2006 |
| GB | 2360469 | A | 9/2001 |

(Continued)

OTHER PUBLICATIONS

International Search Report, in related application No. PCT/DK2007/000244, mailed on Jul. 24, 2007.

(Continued)

*Primary Examiner* — Tramar Harper
(74) *Attorney, Agent, or Firm* — Day Pitney LLP

(57) ABSTRACT

A toy building system comprising a plurality of building elements including one or more function building elements (210) each for performing a corresponding function, and one or more control building elements (400) each for controlling one or more function building elements, each building element including at least one connector for electrically connecting the building element with another building element via a corresponding connector of the other building element, the connector including at least one control signal contact. Each control building element includes a main output connector adapted to output a control signal for controlling at least one function building element; and each function building element includes an input connector for receiving a control signal and is adapted to perform a function responsive to the received control signal. Each function building element further includes an output connector adapted to forward the received control signal.

21 Claims, 4 Drawing Sheets

(56) References Cited

FOREIGN PATENT DOCUMENTS

| | | | |
|---|---|---|---|
| WO | 90/09824 | A1 | 9/1990 |
| WO | 2000/41790 | A2 | 7/2000 |
| WO | 00/45924 | A1 | 8/2000 |
| WO | 2001/97937 | A1 | 12/2001 |
| WO | 2006/042549 | A1 | 4/2006 |
| WO | 2007/137577 | A1 | 12/2007 |

OTHER PUBLICATIONS

International Report on Patentability and Written Opinion of the International Searching Authority, in related application No. PCT/DK2007/000244, issued on Dec. 3, 2008.

* cited by examiner

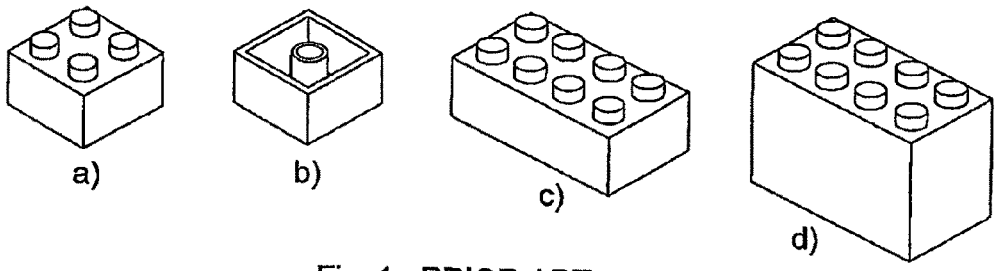
Fig. 1 - PRIOR ART
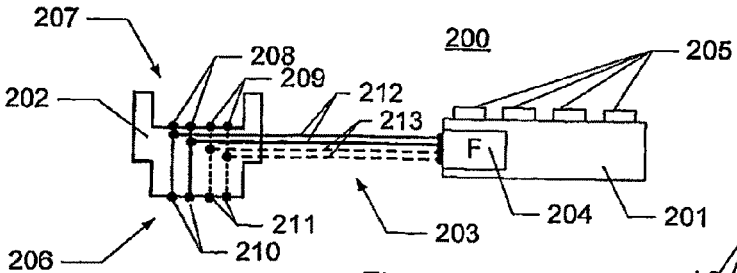
Fig. 2a
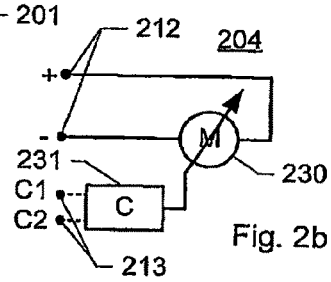
Fig. 2b
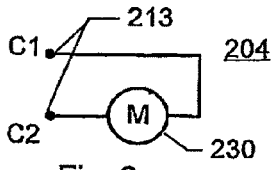
Fig. 2c
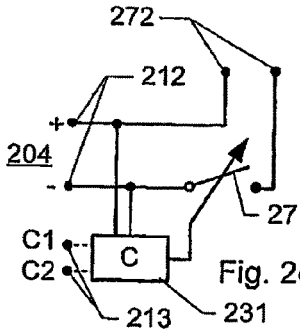
Fig. 2e
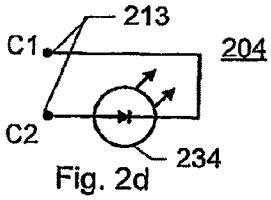
Fig. 2d
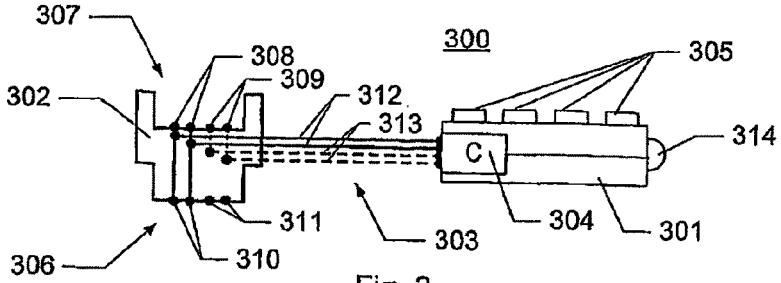
Fig. 3

TOY BUILDING SYSTEM

FIELD OF THE INVENTION

The invention relates to toy building systems comprising building elements with coupling means for releasably interconnecting building elements.

BACKGROUND OF THE INVENTION

Such toy building systems have been known for decades. The simple building blocks have been supplemented with dedicated building elements with either a specific appearance or a mechanical or electrical function to enhance the play value. Such functions include e.g. motors, switches and lamps, but also programmable processors that accept input from sensors and can activate function elements in response to received sensor inputs.

Self-contained function building elements exist which have a function device adapted to perform a preconfigured function, an energy source for providing energy to the function device for performing the function, and a trigger responsive to an external trigger event to trigger the function device to perform the function. Typically, such known function building elements are designed for manual activation of the trigger and only provide a limited play value.

Toy building systems exist that comprise a plurality of building elements including one or more function building elements each for performing a corresponding function, and one or more control building elements each for controlling one or more function building elements, each building element including at least one connector for electrically connecting the building element with another building element via a corresponding connector of the other building element, the connector including at least one control signal contact.

In order to provide an interesting play experience it is generally desirable to provide such a toy building system which allows a user to construct a large variety of models that differ in appearance as well as functionality.

Programmable toys are known e.g. from the product ROBOTICS INVENTION SYSTEM from LEGO MINDSTORMS, which is a toy that can be programmed by a computer to perform unconditioned as well as conditioned actions.

However, it is a problem of the above prior art toy that it requires a relatively complex programming step, e.g. based on user-defined programs created on an external computer and transferred to such a microprocessor controlled toy element, or via a user-interface of the programmable toy itself. Consequently, the generation of such programs requires a relatively high level of familiarity with computers as well as a relatively high level of abstract cognitive capabilities in order to program a desired behaviour, thereby limiting such toys to older children.

Accordingly, it is desirable to provide a toy construction system that includes functional elements that can be configured and controlled in a variety of different ways and in a manner that can easily be understood by children.

It is further desirable to provide a toy building system with new building elements that are suitable for use in the system, and that will enhance the play value of the system.

SUMMARY OF THE INVENTION

Embodiments of the invention relate to a toy building system comprising a plurality of building elements including one or more function building elements each for performing a corresponding function, and one or more control building elements each for controlling one or more function building elements, each building element including at least one connector for electrically connecting the building element with another building element via a corresponding connector of the other building element, the connector including at least one control signal contact/terminal;

wherein each control building element includes a main output connector adapted to output a control signal for controlling at least one function building element; and each function building element includes an input connector for receiving a control signal and is adapted to perform a function responsive to the received control signal;

and wherein each function building element further includes an output connector adapted to forward the received control signal.

Consequently, a plurality of function building elements can be controlled by a single control building element, simply by connecting one function building element to another so as obtain a sequence or chain of interconnected function building elements. A control signal from the control building element fed into the first of the sequence of function building elements is thus forwarded to all function building elements without the need for additional wiring or programming/configuration.

The function building element may thus include a function device adapted to perform a preconfigured function, which function may be selected from a variety of possible functions, including e.g. mechanical and/or electrical functions In some embodiments, the toy building system further comprises a power supply building element including an energy source for supplying electrical power, in particular for providing power to function building elements for performing their respective functions. The power supply building element further includes an output connector; and wherein at least one connector of a building element further includes a power contact. Hence, the individual function building elements and/or control building elements do not need to have their own energy source, but are supplied from a power supply building element via the same connectors that also provide the control signal, i.e. without the need for further wiring or other connections.

In particular, in some embodiments at least one output connector of a building element includes a power contact adapted to provide output electrical power for supplying the electrical power to one or more building elements; and wherein an input connector of each building element includes a power contact adapted to receive electrical power and, optionally, to feed the received electrical power to the function building element.

A power supply building element may provide electrical power only, or the power supply building element may supply both electrical power and a control signal via its output connector. Hence a power supply element may further function as a control building element.

The connectors may be in the form of a plug or receptacle or any other suitable device for terminating or connecting the conductors of individual wires or cables and for providing a means to continue the conductors to a mating connector. To this end, the connector may include a number of contacts arranged in the connector body in a predetermined manner, i.e. a predetermined number, spacing, arrangement, etc. Each contact may be provided as any suitable conductive element configured to provide electrical contact with a corresponding contact in another connector when the connectors are mated for the purpose of transferring electrical energy and/or a control signal.

When each function building element includes a stackable connector element including the input and output connectors of the function building element, uniform connection means are provided that allow an easy connection of a plurality of different function and/or control building elements. In particular, a uniform, stackable connector element provides uniform connection means regardless of the shape and size of the function or control building element.

In particular, in one embodiment each building element including a stackable connector includes a building element body including an electrical circuit; and the stackable connector element is electrically connected to the electrical circuit via an extension cable. Consequently, the building element body may be placed at a position displaced from the connection point where the stackable connector element is connected to, typically a stack of stackable connector elements originating from a power supply building element and/or control building element. Consequently, a greater flexibility in the construction of a toy model is obtained. Furthermore, when the stackable connector element is connected to the building element body of the function or control building element by a flexible extension cable, a greater flexibility in terms of the shape and size of a building element body as well as its placement within a toy construction model is achieved. In particular, the shape, size and placement of the building element body are not limited by a requirement that a connector has to be accessible for connection to another connector.

When the stackable connector is adapted to receive electrical power from the input connector of the stackable connector and to feed the received electrical power to the output connector of the stackable connector element, no additional wiring is required for the distribution of separate electrical power for those function building elements that require more power than is provided by the control signal.

In some embodiments, the stackable connector element of each function building element is adapted to receive a control signal from the input connector of the stackable connector element, and to feed the received control signal to the function building element and to the output connector of the stackable connector element so as to provide a direct control signal path from the input connector to the output connector. Hence, a chain of function building elements can easily be established in a uniform manner by stacking connector elements on top of each other or in any other suitable orientation e.g. next to each other. A control building element thus affects all function building elements that branch out from the output connector of the control building element in an uninterrupted sequence/stack.

One embodiment of a control building element includes a stackable connector element including the main output connector of the control building element and an input connector, and the stackable connector element is adapted to block any control signal output by an output connector connected to the input connector of the stackable control element from being directly fed to the main output connector of the stackable connector element. Hence, the control building element terminates a sequence/stack of function building elements receiving a common control signal. The control building element further provides a base or starting point for a new stack or sequence of function building elements, thereby providing a simple mechanism of grouping function building elements into separately controlled groups, i.e. for controlling which functions in a constructed model are controlled by which control building elements.

Another embodiment of a control building element includes a stackable connector element including an input connector and an output connector different from the main output connector; wherein the stackable connector element is adapted to receive a control signal from the input connector of the stackable connector element and to feed the received control signal to the output connector of the stackable connector element so as to provide a control signal path from the input connector to the output connector. Hence, in this embodiment, the control building element does not terminate a stack/sequence of function elements controlled by another control building element, but the control signal of the other control element is patched through by the stackable connector element. Instead, the control building element operates—via its main output connector—as the starting point of a new stack of function building elements controlled by this control building element.

Nevertheless, in some embodiments, the control building element may receive the input control signal received by the input connector of its stackable connector element. Hence, in such an embodiment, the control building element may generate its output control signal responsive to the received control signal, e.g. by performing a predetermined logic function on the input control signal and, optionally, on a further external input signal from a further input interface/sensor.

Examples of logic functions performed by a control building element include the delay of the output control signal relative to the input control signal, a repetition of the input control signal a predetermined number of times, an output only if the input meets certain criteria e.g. a certain sequence or pattern is received as input, or the input changes in a predetermined way. Further examples include predetermined logic operations based on a comparison of the input control signal and a further activation/trigger input, e.g. a logical 'and' operation, a logical 'and not' operation, or the like.

Accordingly, in some embodiments, a control building element includes a further activation/input interface for receiving an external input from a source different from the control building elements, e.g. a trigger responsive to an external trigger action to trigger the function(s) of the function building element(s) controlled by the control building element, a switch for selecting one of plurality of modes of operation, and/or the like. Thus, the control building element is adapted to generate the output control signal responsive to the external input. The external input may be selected from a variety of possible inputs as described herein. Accordingly, the activation/input interface may comprise any suitable circuitry, device or arrangement suitable to detect an input from a user or another device, to sense a property of the environment, or the like. Examples of such activation interfaces include a push button, a slide, or other mechanical switch, a vibration sensor, a tilt sensor, a touch sensor, an impact sensor, a light sensor, a proximity detector, a thermometer, a microphone, a pressure sensor, a pneumatic sensor, a bus bridge, an inductive input, e.g. an input that is activated by a tag, a radio receiver, a camera, a receiver of a remote control system, e.g. an infrared remote control, etc., or a combination thereof. Hence, a simple mechanism for initiating user-defined functions is provided, thereby providing a variety of interesting play scenarios.

In some embodiments, the toy building system further includes an extension element, the extension element comprising a stackable connector element, a further output connector, and an electrical extension element, such as an extension cable/wire. The stackable connector element includes an input connector and an output connector, and the stackable connector element of the extension element being adapted to receive a control signal from the input connector of the stackable connector element, and to feed the received control signal to the further output connector via the electrical extension element and to the output connector of the stackable connector element. Consequently, the extension element may be used as an extension cable and/or for branching out a parallel stack/sequence of function and/or control building elements.

When the function building elements and/or control building elements have coupling means for releasably interconnecting the function or control building elements with other building elements, they are compatible with the toy building system and can be used together with other building elements. The invention is generally applicable to toy building systems with building elements having coupling means for releasably interconnecting building elements. Furthermore, when the connectors of the of the building elements described herein are configured such that the input connectors are connectable only to output connectors and output connectors are connectable only to input connectors, a mechanical coding is provided that ensures correct wiring/connection of the connectors so as to avoid malfunction, short circuits, and/or the like. For example, such a mechanical coding may be provided by the form of the connector, the contact arrangement in the connector, the form of contacts, by the provision of additional coupling means, and/or the like.

It is noted that the toy building sets may comprise further types of construction elements, such as passive construction elements without any electrical connectors and without capabilities of performing or controlling actions/functions, such as conventional building blocks known in the art.

The present invention can be implemented in different ways including the toy building set described above and in the following and further product means, each yielding one or more of the benefits and advantages described in connection with the first-mentioned toy building set, and each having one or more preferred embodiments corresponding to the preferred embodiments described in connection with the first-mentioned toy building set and/or disclosed in the dependant claims.

In particular, according to one aspect, a function building element is provided for a toy building system, the toy building system comprising a plurality of building elements including one or more function building elements each for performing a corresponding function, and one or more control building elements each for controlling one or more function building elements. The function building element includes at least an input connector and an output connector each for electrically connecting the function building element with another building element via a corresponding connector of the other building element, each connector including at least one control signal contact. The input connector is adapted to receive a control signal and the output connector is adapted to forward the received control signal; and wherein and the function building element is adapted to perform a function responsive to the received control signal.

Furthermore, an embodiment of a control building element is provided for a toy building system, the toy building system comprising a plurality of building elements including one or more function building elements each for performing a corresponding function, and one or more control building elements each for controlling one or more function building elements, each building element including at least one connector for electrically connecting the building element with another building element via a corresponding connector of the other building element, the connector including at least one control signal contact; each function building element including an input connector for receiving a control signal and being adapted to perform a function responsive to the received control signal. The control building element includes a stackable connector element including a main output connector adapted to output a control signal for controlling at least one function building element; wherein the stackable connector element further includes an input connector; and wherein the stackable connector element is adapted to block an control signal output by an output connector connected to the input connector of the stackable control element from being directly fed to the main output connector of the stackable connector element.

Another embodiment of a control building element is provided for a toy building system, the toy building system comprising a plurality of building elements including one or more function building elements each for performing a corresponding function, and one or more control building elements each for controlling one or more function building elements, each building element including at least one connector for electrically connecting the building element with another building element via a corresponding connector of the other building element, the connector including at least one control signal contact; each function building element including an input connector for receiving a control signal and being adapted to perform a function responsive to the received control signal. The control building element includes a main output connector adapted to output a control signal for controlling at least one function building element; wherein the control building element further includes a stackable connector element including an input connector and an output connector different from the main output connector; wherein the stackable connector element is adapted to receive a control signal from the input connector of the stackable connector element and to feed the received control signal to the output connector of the stackable connector element so as to provide a control signal path from the input connector to the output connector.

Furthermore, an embodiment of an extension element is provided for a toy building system, the toy building system comprising a plurality of building elements including one or more function building elements each for performing a corresponding function, and one or more control building elements each for controlling one or more function building elements, each building element including at least one connector for electrically connecting the building element with another building element via a corresponding connector of the other building element, the connector including at least one control signal contact; each function building element including an input connector for receiving a control signal and being adapted to perform a function responsive to the received control signal. The extension element comprises a stackable connector element, a further output connector, and an electrical extension element, the stackable connector element including an input connector and an output connector, the stackable connector element of the extension element being adapted to receive a control signal from the input connector of the stackable connector element, and to feed the received control signal to the further output connector via the electrical extension element and to the output connector of the stackable connector element.

Consequently, a building set is provided with function and control building elements that are interconnectable by a corresponding set of connectors according to a predetermined connection architecture. The building set allows a user to construct a large variety of functions and functional relationships in a uniform manner and with a limited set of different building elements.

BRIEF DESCRIPTION OF THE DRAWINGS

FIG. 1 shows a prior art toy building bricks.

FIG. 2 schematically shows examples of a function toy building brick.

FIGS. 3 and 4 schematically show control toy building bricks.

DETAILED DESCRIPTION OF THE INVENTION

Figure 4A:
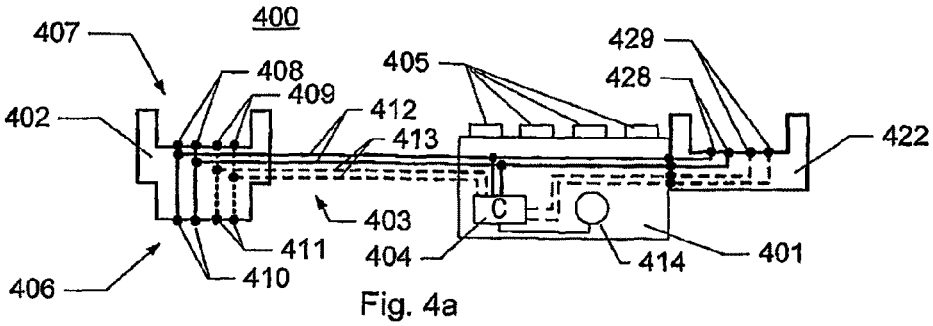

Embodiments of the invention will mainly be described using toy building elements in the form of bricks. However, the invention may be applied to other forms of building elements used in toy building sets.

FIG. 1 shows examples of toy building bricks each with coupling studs on its top surface and a cavity extending into the brick from the bottom. The cavity has a central tube, and coupling studs on another brick can be received in the cavity in a frictional engagement as disclosed in U.S. Pat. No. 3,005,282. FIGS. 1*a*-*b* show perspective views of an example of such a toy building brick including its top and bottom side. FIGS. 1*c* and 1*d* show other such prior art building bricks. The building bricks shown in the remaining figures have this known type of coupling means in the form of cooperating studs and cavities. However, other types of coupling means may also be used.

FIG. 2 schematically show examples of a function building element.

FIG. 2*a* schematically shows a function building element, generally designated 200, including a main function building element body in the form of a function brick 201, and a stackable connector 202 connected to the function brick 201 via flexible cable 203 including wires 212 and 213. The function brick has coupling studs 205 on its top surface and a corresponding cavity in its bottom surface (not explicitly shown). The function brick 201 includes a function device 204 that receives electric power via terminals 210 of the stackable connector 202 and lines 212 of the extension cable 203, and a control signal via terminals 211 of the stackable connector 202 and lines 213 of the extension cable 203, as will be described in more detail below, and the electrical function device 204 performs a preconfigured function, e.g. a mechanical or an electrical function. In one embodiment, the control signals may each have binary values 0 and 1, respectively.

Examples of a preconfigured mechanical function that the function bricks described herein can perform include movements/motion such as by driving a rotating output shaft, winding-up a string or a chain which enables pulling an object closer to the function brick, fast or slow moving a hinged part of the function brick which enables e.g. opening or closing a door, ejecting an object, etc. Such mechanical motions can be driven by an electric motor as illustrated in FIG. 2*b*. FIG. 2*b* shows a wiring diagram of an example of a function device 204 that includes a motor 230 driven by the received electrical power via lines 212. The motor 230 is controlled by a control circuit 231 in response to the control signals C1, C2 received via lines 213.

It will be appreciated that the motor may be driven by the power from the power lines 212 or directly by the control signals C1 and C2, as illustrated by FIG. 2*c*. The separate power supply via lines 212 allows a supply in such a way that the polarity of the voltage is constant and well-defined.

FIG. 2*c* schematically shows a wiring diagram of another example of a function device 204 including a motor 230 that is controlled and driven by the control signals C1, C2. Hence, in this example, the function device does not receive separate electric power via lines 212, as the control signal is sufficient to operate the motor.

Examples of the preconfigured electrical function that the function bricks described herein can perform include operating a switch with accessible terminals, generating a visible light signal, emitting constant or blinking light, activating several lamps in a predetermined sequence, generating an electrical signal, generating an invisible light signal, emitting audible sound such as beep, alarm, bell, siren, voice message, music, synthetic sound, natural or imitated sound simulating and stimulating play activities, recording and playback of a sound, emitting inaudible sound such as ultrasound, emitting a radio frequency signal or an infrared signal to be received by another component, etc. or combinations of the above.

The function bricks may have a preconfigured function, but functions may also be programmed or otherwise determined or influenced by the user.

FIG. 2*d* schematically shows a wiring diagram of an example of a function device 204 including an LED 234 that is controlled and driven by the control signals C1, C2. Hence, in this example, the function device does not receive separate electric power via lines 212, as the control signal is sufficient to operate the LED. Alternatively, the LED may be driven by the power received via lines 212 via a switch controlled by control signals C1 and or C2.

In FIG. 2*e* is illustrated that the function device 204 can be a switch 271. The switch 271 can be a normally open or a normally closed switch, and its terminals 272 can be connected to the coupling studs on the top surface or to the surfaces in the cavity that are intended for engaging coupling studs on other building bricks. The switch is controlled by the control signal received via lines 213 via logic circuit 231 as described above. When the switch 271 is closed, the voltage on power lines 212 is applied to the terminals 272. The logic circuit 231 further receives electrical power from power lines 212.

Generally, the function device may interpret the control signals in different ways. In one embodiment, the control signals C1 and C2 may each have binary values 0 and 1, respectively. For example, in the example of FIG. 2*c*, the motor 230 may be controlled according to the following table:

| Control signal value | Motor control |
|---|---|
| (C1, C2) = (0, 0) | Motor OFF |
| (C1, C2) = (1, 0) | Motor ON Forward |
| (C1, C2) = (0, 1) | Motor ON reverse |
| (C1, C2) = (1, 1) | Motor Break |

In another example where the function device includes a sound generator configurable to play two different sounds, the function device may be adapted to play a selected one of the sounds responsive to e.g. a rising flank (i.e. a transition from 0 to 1) of the individual control signals C1 and C2 respectively, e.g. according to C1 0→1 play sound 1

C2 0→1 play sound 2.

Hence, in general, the function device may include any suitable mechanical and/or electrical device, arrangement or circuitry adapted to perform one or more of the above or alternative functions. Examples of function devices include a light source such as a lamp or LED, a sound generator, loudspeaker, sound card, or other audio source, a motor, a gear, a hinged part, a rotatable shaft, a signal generator, a valve, a pneumatic control, a shape-memory alloy, a piezo crystal, an electromagnet, a linear actuator, a radio, a display, a microprocessor, and/or the like.

The stackable connector element 202 includes both a male input connector 206 and a female output connector 207. The connectors are positioned on opposite sides of the connector element, so as to make the connector element stackable. In particular, in the present example, the male input connector is positioned on the bottom side, while the female connector is positioned on the upper side of the stackable connector element. The input and output connectors include four contacts each, designated 210, 211, and 208, 209, respectively. The contacts 210 for receiving electrical power are connected to the corresponding output contacts 208 and to the function device 204 via lines 212. The contacts 211 for receiving control signals are connected to the corresponding output contacts 209 and to the function device 204 via lines 213. It is generally preferable that the input and output connectors 206 and 207 are mechanically coded so that the contacts are always connected to the correct corresponding contacts of the corresponding other connector.

When all function building elements of a toy building set include corresponding stackable connector elements providing and forwarding control and power input in a uniform manner, such function bricks may easily be interchanged within a toy construction built from the building bricks described herein. For example, a function brick including a lamp may simply be replaced by a function brick including a sound source or loudspeaker, without having to change any other part of the construction, since both function bricks are activated in the same way.

Generally, in one embodiment, each building element described herein, e.g. each function, control, power supply, or extension building element, may have at most one input connector and any number of output connectors.

It is further understood that each building element may use one or more of the input contacts in its input connector. For example, as described herein, some function building elements may only use the control signals while other function building elements may use both the electrical power and the control signals. Similarly, as will be described in greater detail below, some control building elements may use only the power, while other control building elements may use both the input power and the input control signals.

It is further understood that the connector element may include further contact points, e.g. signal lines for providing a communication bus between building elements including microprocessors.

FIGS. 3 and 4 schematically show control toy building elements.

FIG. 3 schematically shows an example of a control building element, generally designated 300, including a main control building element body in the form of a control brick 301, and a stackable connector 302 connected to the control brick 301 via flexible cable 303. The control brick has coupling studs 305 on its top surface and a corresponding cavity in its bottom surface (not explicitly shown). The control brick 301 includes a control device 304 that receives electric power via terminals 310 of the stackable connector 302 and lines 312 of the extension cable 303. The control brick 301 further includes a push button 314, or another input interface for receiving an external input, connected to the control device 304.

In general, the control bricks described herein may include one or more input interfaces/sensors responsive to an external physical event. Examples of such external physical events comprise mechanical forces, push, pull, rotation, human manipulation, touch, proximity of an object, electrical signals, radio frequency signals, optical signals, visible light signals, infrared signals, magnetic signals, temperature, humidity, radiation, etc. and combinations thereof.

The control brick 301 generates a control signal in response to an activation of the push button 314 and feeds the control signal to the output contacts 309 of the stackable connector element 302 via lines 313 of the extension cable 303. The output connector 307 of the stackable connector element 302 is thus referred to as the main output connector of the control building element 300.

The stackable connector element 302 is similar to the connector element described above and it includes a male input connector 306 with input contacts 310 for electrical power and input contacts 311 for control signals, a female output connector 307 with output contacts 308 for electrical power and output contacts 309 for control signals. The contacts 310 for receiving electrical power are connected to the corresponding output contacts 308 and to the control device 304 via lines 312. However, in contrast to the connector element of FIG. 2*a*, the contacts 311 for receiving control signals are neither used by the control device 304, nor are they connected to the corresponding output contacts 309. Hence, any control signal received via an output connector connected to the input connector 306 is not forwarded to the output connector 309.

When each main output connector of the control building elements of a toy building set is arranged as an output connector of a uniform stackable connector element, the control bricks are easily interchangeable. Hence, in a toy construction built with bricks as described herein, several control bricks can be used interchangeably, and a particular control brick can be used in several constructions. Nevertheless, in some embodiments, the main output connector of a control building element may also be implemented as a separate output connector different from the stackable connector element, as will be described in greater detail below.

The control device 304 may simply translate the external input in a suitable control signal. Alternatively, the control device may perform a logic function on the one or more received external events. Examples of such logic functions comprise a delayed output relative to the input, a repeated control signal upon receipt of a single input, an output only if the input meets certain criteria e.g. a certain sequence or pattern is received as input, etc.

FIG. 4 illustrate examples of control building elements, generally designated 400, that have a main output connector 422 separate from the output connector 407 of the stackable connector element 402 of the control building element.

FIG. 4*a* shows a control building element including a control brick 401 with coupling studs 405 and a control device 404 that receives a control input from an external interface 414 similar to the control building element described above, and generates a corresponding output control signal. Furthermore, the control building element 400 includes a stackable connector element 402, connected to the control brick 401 via extension cable 403, the stackable connector element having a male input connector 406 and a female output connector 407, and including input contacts 410 for electrical power and output contacts 408 connected to the input contacts 410. The control device 404 thus receives electrical power via the stackable connector element and lines 412 of the extension cable 403.

The control building element 400 of FIG. 4*a* differs from the control building element 300 of FIG. 3 in that it further comprises a separate female output connector 422 that functions as a main output connector, as the control device 404 feeds its output control signal to the corresponding output contacts 429 of the connector 422. The control brick 401 further feeds the received electrical power to the corresponding output contacts 428 of the connector 422, thereby providing an uninterrupted power line through the system. The separate output connector may be connected to or integrated in the brick 401, or it may be arranged separate from the brick 401, e.g. connected to the brick 401 by an extension cable.

Furthermore, in contrast to the control building element 300, the stackable connector element 402 includes a connection between the control signal input contacts 410 to the corresponding output contacts 409, thus providing a direct control signal path from its input to the output.

The input control signal is further fed from contacts 410 via line 413 of the extension cable 403 to the control device 404. Furthermore, the control device 404 receives electrical power from lines 412. Accordingly, the control device 404 generates the output control signal based on the input control signal and/or on the external input from interface 414, e.g. by combining the two control inputs, e.g. by implementing a logic function such as an 'AND' function, an 'OR' function, and 'XOR' function, by using a change in the input control signal as a trigger event, or the like. Generally, the logic function may be a preconfigured logic function, but logic functions may also be programmed or otherwise determined or influenced by the user. In some embodiments the control device may use the input control signal and/or the external input as a trigger signal for triggering an output control signal or for triggering a control process resulting in an output control signal. For example, the control device may have stored therein an executable program, execution of which may be triggered by a predetermined input control signal and may result in an output control signal or sequence of output control signals.

Figure 4B:
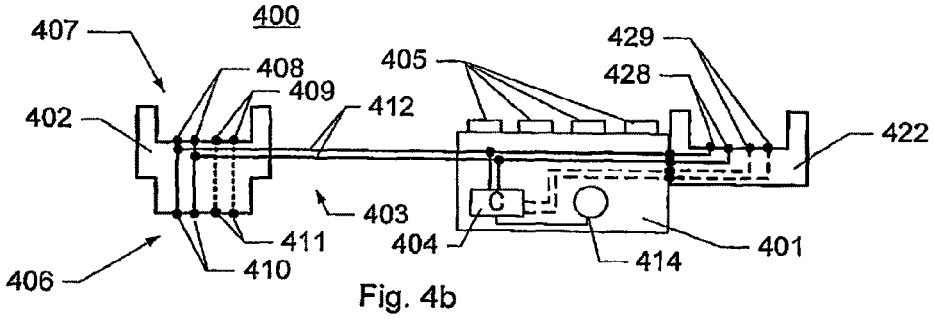

FIG. 4*b* shows an embodiment similar to the one in FIG. 4*b*, but where the control device does not receive the input control signal from the stackable connector element 402. Hence, in this embodiment, the contacts 410 are only connected to the output contacts 408.

Figure 4C:
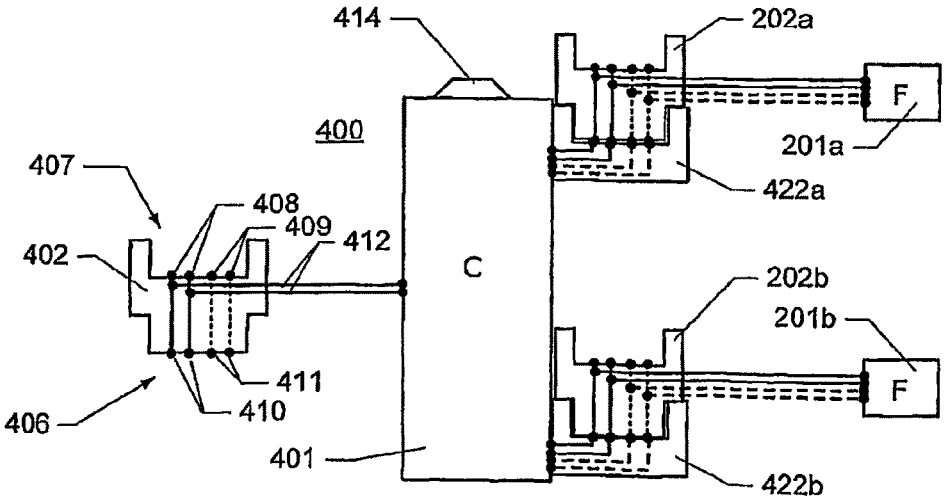

FIG. 4*c* shows a further embodiment which is similar to the embodiment of FIG. 4*b*, but where the control brick 401 includes two main output connectors 422*a* and 422*b*, each receiving electrical power and respective control signals. The control signals fed to the output connectors may be identical or different. Hence, the control building element of FIG. 4*c* may control two parallel function building elements or stacks of function elements, as illustrated by function bricks 201*a* and 201*b* connected to output elements 422*a* and 422*b*, respectively, via their respective stackable connector elements 202*a* and 202*b*. For example, the control building element may be an IR receiver of a remote control system which selectively outputs control signals on the different output connectors in response to different received IR signals. Hence, different function building elements may be selectively controlled via a single remote control.

Figure 5:
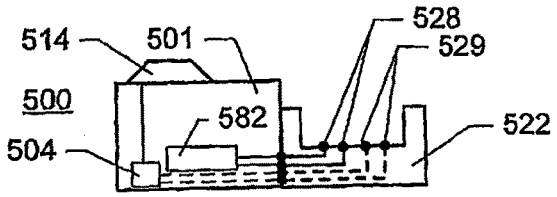
FIG. 5 schematically shows a power supply building brick.

FIG. 5 schematically shows a power supply building element. The power supply element, generally designated 500, includes a power supply brick and a female output connector 522 similar to the output connector 422 described above. The power supply brick includes one or more batteries 582 for generating a low-voltage electric power suitable for a toy construction set, e.g. a power of between 4.5V and 9V. Alternatively, the power supply element may include an alternative energy source, e.g. a voltage transformer/converter. The power from the battery 582 is output via output contacts 528 of the output connector 522. The power supply building element 500 further includes a control switch 514 or other input interface connected to a control device 504 included in the main body 501 that generates a control signal in response to an activation of the control switch 514 and feeds the control signal to contacts 529 of the output connector 522. Thus the power supply element functions both as a power supply for function and/or control building elements connected to its output connector 522 and as a control element similar to the control element shown in FIG. 4*b*. It is understood that alternative embodiments of the power supply element may not include any control switch and only provide output power but no output control signal. Furthermore, in yet further alternative embodiments, a power supply element may include more than one output connectors.

Figure 6:
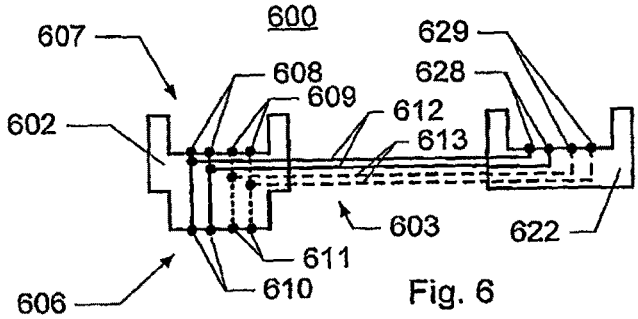
FIG. 6 schematically shows an extension building element.

FIG. 6 schematically shows an extension building element. The extension element, generally designated 600, includes a stackable connector 602 and a female output connector 622 connected by ah extension cable 603. The stackable connector 602 is similar to the stackable connector of a function building element and includes a male input connector 606 and a female output connector 607. The input connector 606 includes contacts 610 for electrical power and contacts 611 for control signals. Contacts 610 for electrical power are connected with corresponding contacts 608 of the output connector 607, and via lines 612 of extension cable 603 with contacts 628 of the output connector 622. Similarly, contacts 611 for control signals are connected with corresponding contacts 609 of the output connector 607, and via lines 613 of extension cable 603 with contacts 629 of the output connector 622. Hence, the extension element may be used both as an extension cable and as a branch element, since the input power and control signals are forwarded both to output connector 607 and output connector 622.

FIG. 7 schematically show examples of toy models including building elements described herein.

Figure 7A:
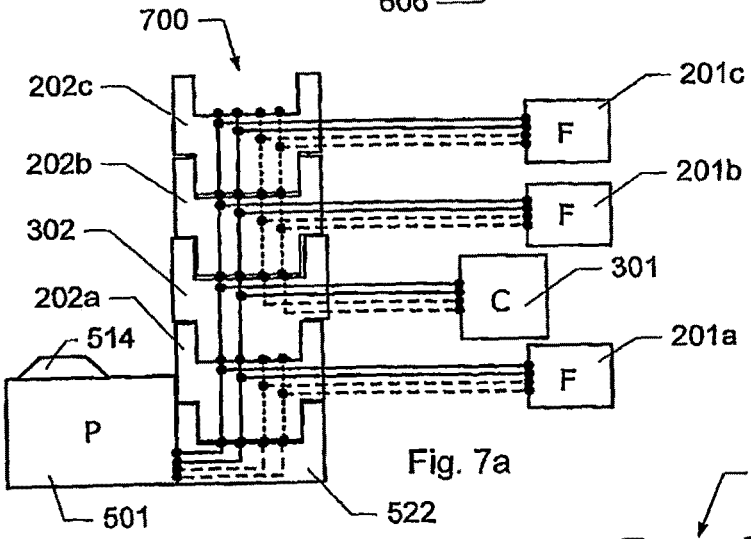
FIG. 7 schematically show examples of toy models including building bricks described herein.

The toy model shown in FIG. 7*a* illustrates an example including a power supply brick 501 with an output connector 522 which supplies power to function bricks 201*a-c* and to a control brick 301 of the type shown in FIG. 3 via their respective stackable connector elements 202*a-c* and 302. Hence, the function bricks 201*a-c* and the control brick 301 are arranged in a stack in a sequential order defined by the position of their respective stackable connectors within the stack 700. The power supply brick 501 further provides a control signal to function brick 201*a* via the female connector of the stackable connector element 302, while the control brick 301 provides a control signal to function bricks 201*b* and 201*c*. Since the control signal input and output contacts of the connector element 302 are not connected with each other, the power supply brick 501 does not control function bricks 201*b* and 201*c*, i.e. power supply brick 501 only controls function bricks connected higher in the stack 700 than the power supply brick 501 up to the control brick 301. Furthermore, since the output control signal from control brick 301 is only fed to the contacts of the female output connector of the connector element 302, the control brick 301 only controls function bricks connected higher in the stack 700 than the control brick 301.

Figure 7B:
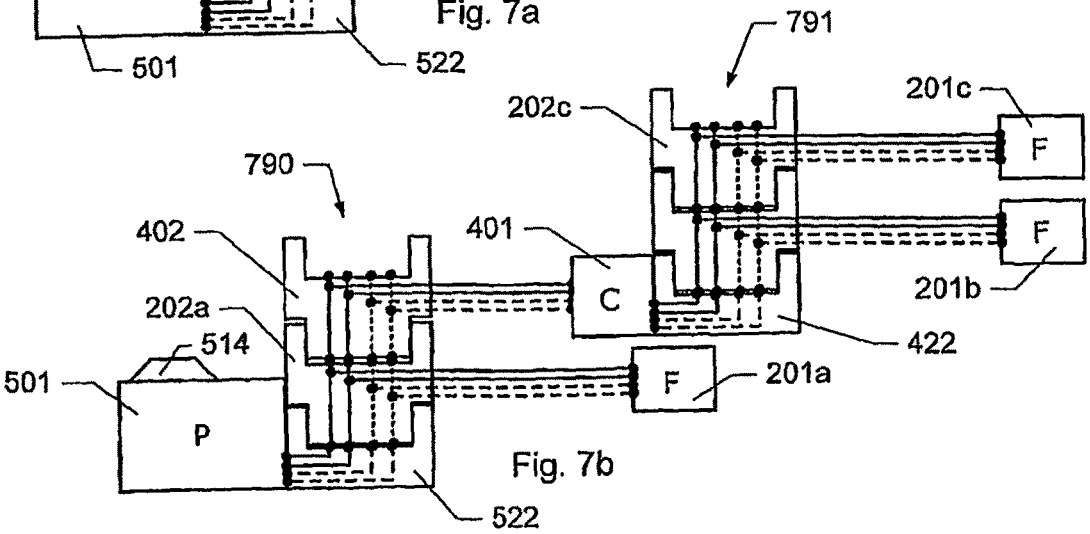

The toy model shown in FIG. 7*b* illustrates another example including a power supply brick 501 with an output connector 522 which supplies power to function bricks 201*a-c* and to a control brick 401 of the type shown in FIG. 4*a* via their respective stackable connector elements 202*a-c* and 402. Hence, the function brick 201*a* and the control brick 401 are connected via their respective stackable connector elements in a first stack 790 originating from the power supply brick 501, while function bricks 201*b* and 201*c* are connected in a second stack 791 originating from the output connector 422 of control brick 401. Thus, in this example the power supply element provides power to all function and control elements in stack 790 as well as—via control brick 401—to the elements in stack 791.

Control brick 401 controls function bricks 201*b* and 201*c*. Furthermore, since the control brick 401 is of the type that receives the control signal from its stackable connector, as was described in connection with FIG. 4*b*, the power supply brick 501 controls both function brick 201*a* and function bricks 201*b* and 201*c*. The latter control of function bricks 201*b* and 201*c* is performed indirectly via control brick 401 and in accordance with the specific logic function implemented by control brick 401. Different control elements may interpret the incoming control signal in different ways when generating its output control signal, e.g. by performing predetermined logic operations and/or by utilising transitions/changes in the incoming control signal(s) as event triggers and/or the like.

Figure 8:
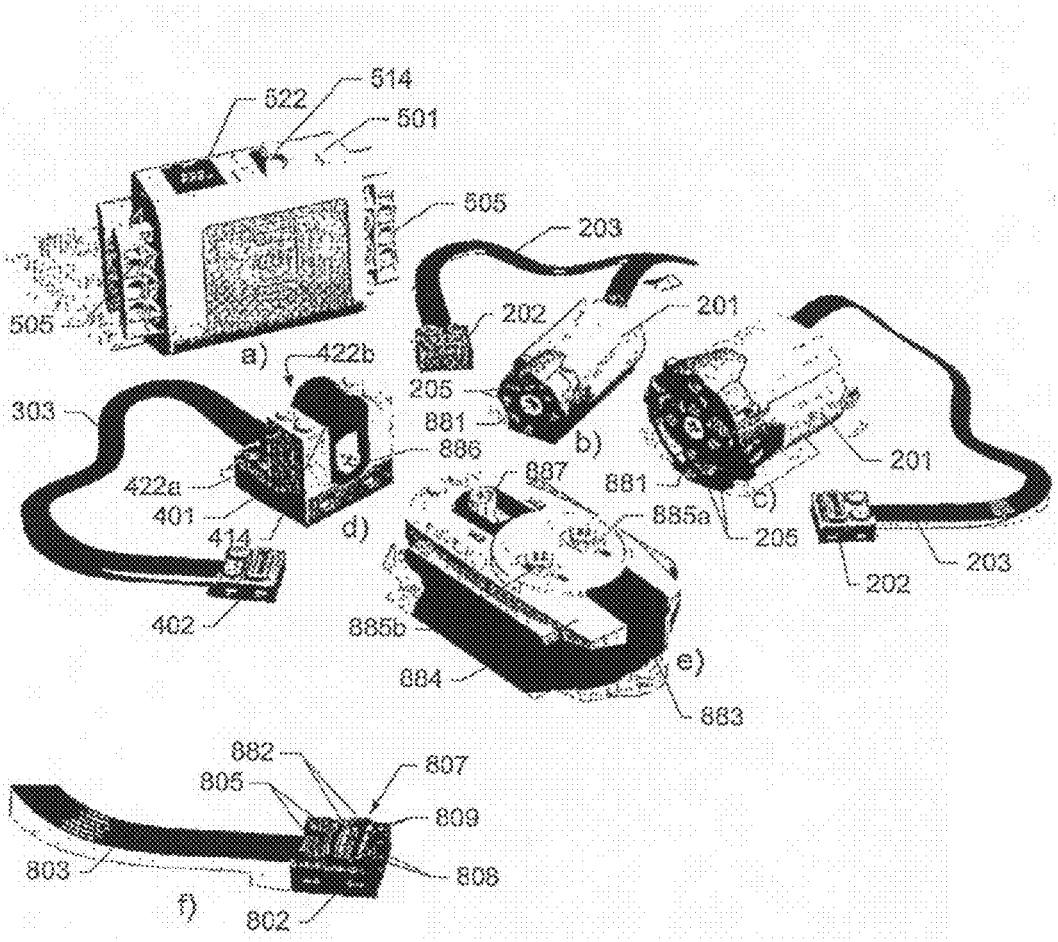
FIG. 8 show further examples of toy building bricks.

FIG. 8 show further examples of toy building elements.

FIG. 8*a* shows an example of a power supply brick 501 including a battery (not shown) which provides electrical power from a female output connector 522. The power supply brick 501 includes a slide switch 514, and coupling means 505.

FIGS. 8*b-c* each shows an example of a motor module 201 as an example of a function building element. The motor module 201 includes a hole 881 for receiving a shaft to be rotated by the motor. The motor module further includes coupling means 205 for connecting the motor module with other building elements. The motor module further includes a stackable connector element 202 as described herein.

FIG. 8*d* shows an example of a control building element as described in connection with FIG. 4*c* for providing control signals via two output connectors. The control element includes a control brick 401 with an infra-red (IR) receiver 414 and is adapted to output, in response to the received IR signal, control signals on two output connectors 422*a* and 422*b*, one of which is partly visible, while the other one is hidden in FIG. 8*d*. The control element receives electrical power via the stackable connector element 402. Furthermore, the control element includes a selector switch 886 for selecting one of two reception frequency channels. Hence the control building element may be used as a receiver of a remote control.

FIG. 8*e* illustrates an example of a remote controller for activating the remote control receiver of FIG. 8*d*. The remote controller 884 includes an IR transmitter 883 which transmits respective IR signals in response to the operation of one or more buttons/switches 885*a-b*, and a frequency selector switch 887. In one embodiment, the control element of FIG. 8*d* is configured to output a control signal on its output connector 422*a* in response to an IR signal indicative of an activation of switch 885*a*, while the control element of FIG. 8*d* is configured to output a control signal on its output connector 422*b* in response to an IR signal indicative of an activation of switch 885*b*.

FIG. 8*f* shows an example of a stackable connector 802 for use in the function, control, and/or extension building elements described herein. In particular, FIG. 8*f* shows the connector element 802, the flexible extension cable 803, and the female connector 807 of the stackable connector including contacts 808 for outputting electrical power, contacts 809 for outputting control signals, and further contacts 882 for outputting additional signals, e.g. for use as a high-speed communication line for distributed intelligence. The connector element further includes coupling studs 805 for easy and reliable connection of the connector element to a male connector having one or more corresponding cavities.

The invention claimed is:

1. A toy building system comprising a plurality of building elements including two or more function building elements each for performing a corresponding function, and one or more control building elements each for controlling one or more function building elements, each building element including at least one connector for electrically connecting the building element with another building element via a corresponding connector of the other building element, the connector including at least one control signal contact;

wherein each of the one or more control building elements includes a main output connector configured to output a control signal for controlling at least one function building element; and wherein the two or more function building elements are interconnectable so as to form a sequence of interconnected function building elements, and wherein each of the two or more function building elements includes an input connector for receiving a control signal from one of the one or more control building elements or from a preceding function building element of the sequence of interconnected function building elements, and wherein an output connector is configured to forward the received control signal to a subsequent function building element of the sequence of interconnected function building elements different from the preceding function building element; and wherein each of the two or more function building elements is configured to perform a function responsive to the received control signal, in addition to forwarding the received control signal.

2. A toy building system according to claim 1, further comprising a power supply building element including an energy source for supplying electrical power and an output connector; and wherein the at least one connector of a building element further includes a power contact.

3. A toy building system according to claim 2 wherein the at least one output connector of a building element includes a power contact configured to provide output electrical power for supplying the electrical power to one or more building elements; and wherein the input connector of each building element includes a power contact configured to receive electrical power.

4. A toy building system according to claim 2, wherein the power supply building element is further configured to output a control signal via the output connector of the power supply building element.

5. A toy building system according to claim 1, wherein each of the two or more function building elements include a stackable connector element including the input and output connectors of the two or more function building elements.

6. A toy building system according to claim 5, wherein the stackable connector element of each of the two or more function building elements is configured to receive a control signal from the input connector of the stackable connector element, and to feed the received control signal to each of the two or more function building elements and to the output connector of the stackable connector element so as to provide a direct control signal path from the input connector to the output connector.

7. A toy building system according to claim 5, wherein each building element including a stackable connector element and a building element body includes an electrical circuit; and wherein the stackable connector element is electrically connected to the electrical circuit via an extension cable.

8. A toy building system according to claim 5, further comprising a power supply building element including an energy source for supplying electrical power and an output connector; and wherein each stackable connector is configured to receive the electrical power from the input connector of the stackable connector and to feed the received electrical power to the output connector of the stackable connector element.

9. A toy building system according to claim 5, wherein each stackable connector includes a first connecting side including the input connector of the stackable connector element, and a second connecting side opposite the first connecting side, the second connecting side including the output connector of the stackable connector element.

10. A toy building system according to claim 1, wherein each of the one or more control building elements of at least a first subset of control building elements includes a stackable connector element including the main output connector of the control building element and an input connector; wherein the stackable connector element is configured to block any control signal output by an output connector connected to the input connector of the stackable control element from being directly fed to the main output connector of the stackable connector element.

11. A toy building system according to claim 10, wherein each of the one or more control building elements of at least a second subset of control building elements includes a stackable connector element including an input connector and an output connector different from the main output connector; wherein the stackable connector element is configured to receive a control signal from the input connector of the stackable connector element and to feed the received control signal to the output connector of the stackable connector element so as to provide a control signal path from the input connector to the output connector.

12. A toy building system according to claim 11, wherein the stackable connector element is configured to feed the received control signal to each of the one or more control building element.

13. A toy building system according to claim 1, further including an extension element, the extension element comprising a stackable connector element, a further output connector, and an electrical extension element, the stackable connector element including an input connector and an output connector, the stackable connector element of the extension element being configured to receive a control signal from the input connector of the stackable connector element, and to feed the received control signal to the further output connector via the electrical extension element and to the output connector of the stackable connector element.

14. A toy building system according to claim 1, wherein each of the one or more control building elements include a further input interface for receiving an external input; and wherein each of the one or more control building elements is configured to generate the output control signal responsive to the external input.

15. A toy building system according to claim 14 wherein the external input is selected from the group comprising mechanical forces, push, pull, rotation, human manipulation, touch, proximity of an object, electrical signals, radio frequency signals, optical signals, visible light signals, infrared signals, magnetic signals, temperature, humidity, radiation.

16. A toy building system according to claim 1, wherein each building element includes coupling means for releasably interconnecting building elements.

17. A toy building system according to claim 16, wherein each connector includes coupling means for releasably interconnecting building elements.

18. A toy building system according to claim 16 wherein the coupling means comprise protrusions and cavities configured to receive protrusions in a frictional engagement.

19. A toy building system according to claim 1 wherein the input connectors are connectable only to output connectors and output connectors are connectable only to input connectors.

20. A toy building system according to claim 1, wherein the function is selected from the group comprising motion, generating an audible sound signal, generating an inaudible sound signal, generating an electrical signal, generating a visible light signal, generating an invisible light signal, generating a radio frequency signal.

21. A toy building system according to claim 1, comprising a plurality of function building elements whose function devices are configured to perform different functions.

* * * * *